United States Patent [19]

Marks

[11] Patent Number: 4,875,725

[45] Date of Patent: Oct. 24, 1989

[54] WOVEN-WIRE GATE LOCK

[76] Inventor: George R. Marks, 19, The Hemlocks, Roslyn Estates, N.Y. 11576

[21] Appl. No.: 138,133

[22] Filed: Dec. 28, 1987

[51] Int. Cl.[4] ..... E05B 15/04

[52] U.S. Cl. ..... 292/244; 292/337; 70/462; 70/450

[58] Field of Search ..... 70/448, 450, 451, 461, 70/462, 466; 292/337, 244, 245, DIG. 53, DIG. 51, DIG. 60, DIG. 64, 163, 164, 165, 166, 167

[56] References Cited

U.S. PATENT DOCUMENTS

| | | | |
|---|---|---|---|
| 1,298,861 | 4/1919 | Babbitt | 292/337 X |
| 1,460,133 | 6/1923 | Hurd | 292/337 X |
| 1,578,483 | 3/1926 | Teich | 70/462 |
| 1,619,032 | 3/1927 | Parsons | 292/173 |
| 1,820,565 | 8/1931 | Hines | 70/462 X |
| 1,858,525 | 5/1932 | Schrofoer | 70/462 |
| 2,096,978 | 10/1937 | Ritterbusch | 292/167 |
| 2,136,539 | 11/1938 | Brinton | 292/163 |
| 2,232,937 | 2/1941 | Brauning et al. | 292/169.15 |
| 2,267,780 | 12/1941 | Zion | 70/462 X |
| 2,304,612 | 12/1942 | Voight | 292/337 X |
| 3,594,031 | 7/1971 | Ford | 70/100 X |
| 3,750,433 | 8/1973 | Sanders | 292/165 X |
| 4,243,256 | 1/1981 | Frydrych | 292/245 |

FOREIGN PATENT DOCUMENTS

| | | | |
|---|---|---|---|
| 222299 | 10/1924 | United Kingdom | 292/244 |

*Primary Examiner*—Gary L. Smith
*Assistant Examiner*—Eric K. Nicholson
*Attorney, Agent, or Firm*—Alan H. Levine

[57] ABSTRACT

A lock, particularly adapted for use with the gate of a woven-wire partition, includes a housing having a faceplate, a wall projecting from the faceplate and substantially surrounding the interior of the housing, and a removable cover for closing the housing. A stationary bracket is located within the housing, and a latch is movable with respect to the housing between latched and unlatched positions, in response to operation of manually-manipulable means, such as a key-operable lock cylinder or a hand-operable fingerpiece. A member within the housing is cooperable with the stationary bracket for preventing movement of the latch in a direction transverse to the plane of the faceplate, so as to prevent the latch from accidentally falling out of the housing when the housing cover is removed and the housing is open. A spring within the housing serves two functions, namely, constantly urging the latch toward its unlatched position, and maintaining cooperation between the member and the bracket.

13 Claims, 6 Drawing Sheets

FIG. 7
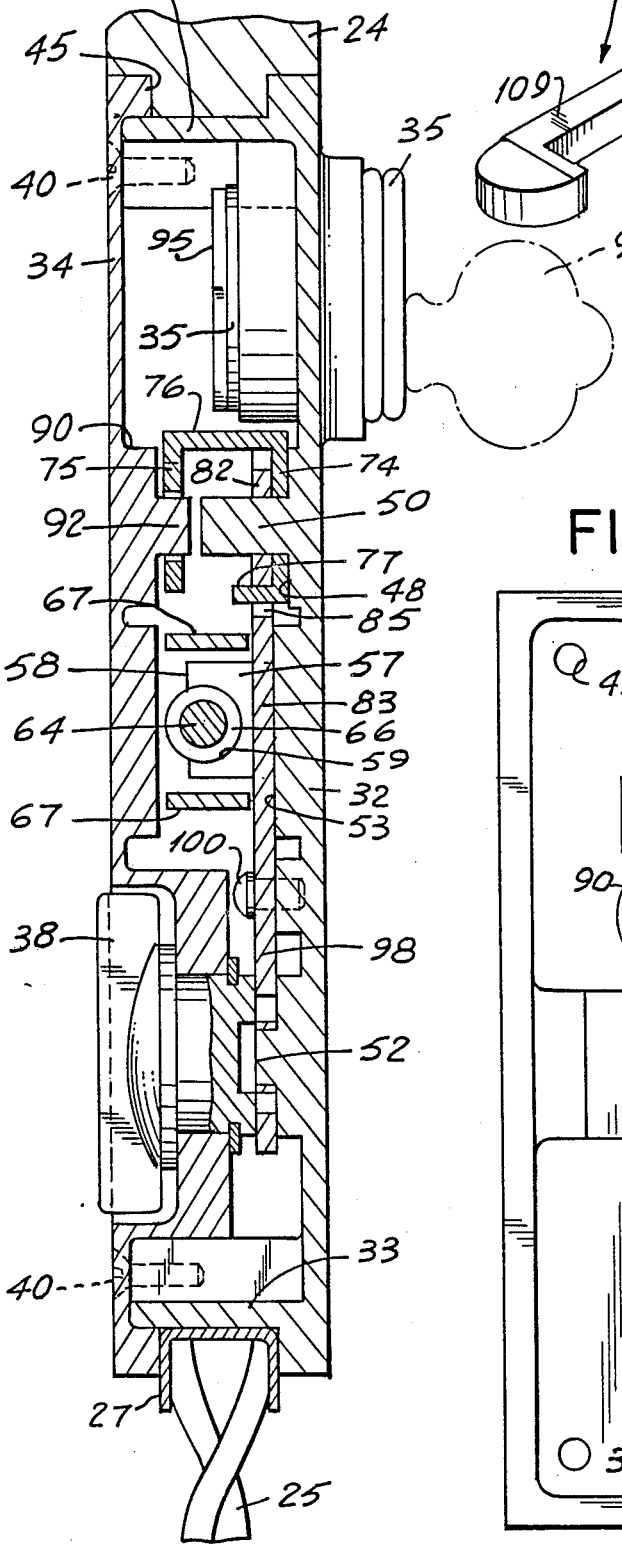
FIG. 15
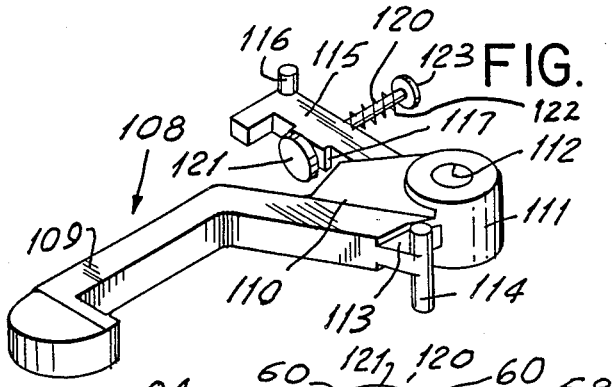
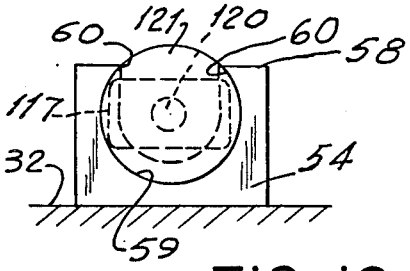
FIG. 16
FIG. 8
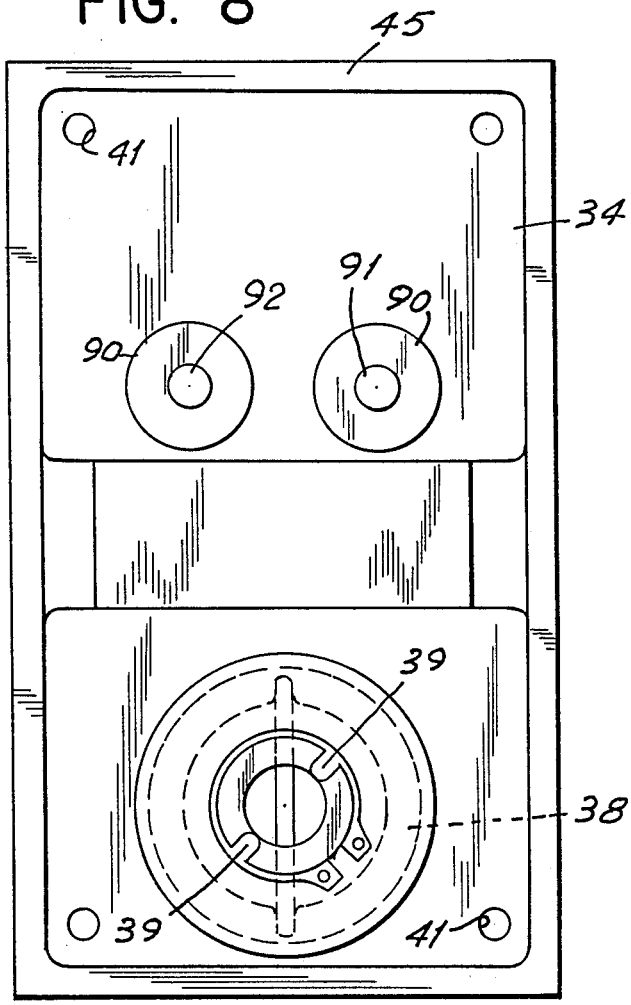

WOVEN-WIRE GATE LOCK

This invention relates to locks, and more particularly to locks employed on the gates of woven-wire partitions.

Woven-wire partitions are typically used to define a separate secure area within a larger interior space. For example, the secure area may be a storage area for valuable inventory items, or a storage and supply area for expensive tools. Access to the enclosed area is provided by means of a gate, which may be of the swinging type, hinged along one of its vertical edges, or the sliding type, supported on horizontal tracks. In either case, the gate is provided with a lock having a projecting latch which cooperates with a keeper fixed to the jamb of the gate.

The woven-wire gate is provided with a rectangular opening for accommodating the lock housing, the opening being bordered by metal frame elements, upon which the lock housing is mounted. In U.S. Pat. No. 3,594,031, a woven-wire gate lock is shown having a housing, the four edge walls of which are flush. This lock is inserted into the rectangular opening in the gate, and secured to the frame elements by screws extending through the edge walls of the lock housing.

A lock similar to the one shown in U.S. Pat. No. 3,594,031 has been made in which the four edge walls are spaced inwardly from the edges of the faceplate and removable coverplate which form the remainder of the lock housing. In this way, an inwardly-directed channel is created along all four edges of the lock housing. This arrangement has the advantage that it is not required to attach the housing to the frame elements by screws. Instead, by removing the cover, the four edge walls of the housing can be inserted into the opening in the gate, the faceplate and cover of the housing being larger than the dimensions of the opening. After the edge walls are inserted, the cover is reattached to the remainder of the housing so as to secure the housing to the frame elements, the frame elements being accommodated within the edge channel of the housing so as to be sandwiched between the opposed edge areas of the faceplate and cover of the housing. The fact that the cover of the housing must be removed to so mount the lock is usually not a disadvantage, since typically the cover must be removed so as to adjust the orientation of the latch with respect to the housing, depending upon whether the gate is a right or left swinging gate, or a right or left sliding gate.

A serious disadvantage is, however, associated with a lock of the type shown in U.S. Pat. No. 3,594,031, especially at the time that the cover of the housing is removed and the lock is being mounted on the gate. The disadvantage involves the fact that should the open housing be dropped accidentally, or even held with the open side of the housing facing downwardly, the latch and other internal parts of the lock will fall out of the housing. Thus, the open housing must be handled rather carefully while the lock is being mounted on the gate, and should the internal lock parts accidentally fall out of the housing, time is consumed in properly reassembling the parts within the housing before mounting of the lock can proceed.

Therefore, it is an object of the present invention to provide a woven-wire gate lock in which the latch and all other internal parts of the lock remain properly assembled within the housing even if the housing is dropped while in an open condition.

It is another object of this invention to provide such a lock which nevertheless has desirable features of earlier wovenwire gate locks in that the same housing can be used whether the gate is of the swinging type of sliding type, and latches can be assembled with the housing in two different orientations so that the same lock can be used with right or left swinging gates or right or left sliding gates.

It is a further object of the invention to provide such a lock wherein a single spring serves both to constantly urge the latch toward its latched position, and also serves to maintain the cooperation between elements within the lock housing for preventing the parts of the lock from accidentally falling out of the lock housing.

Additional objects and features of the present invention will be apparent from the following description, in which reference is made to the accompanying drawings.

In the drawings

FIG. 7 is a generally vertical cross-sectional view taken along line 7—7 of FIG. 5;

FIG. 8 is a face view of the inside face of the lock housing cover;

FIG. 15 is a perspective view of the latch employed with the lock of FIG. 13; and FIG. 16 is a fragmentary cross-sectional view taken along line 16—16 of FIG. 13.

Figure 1:
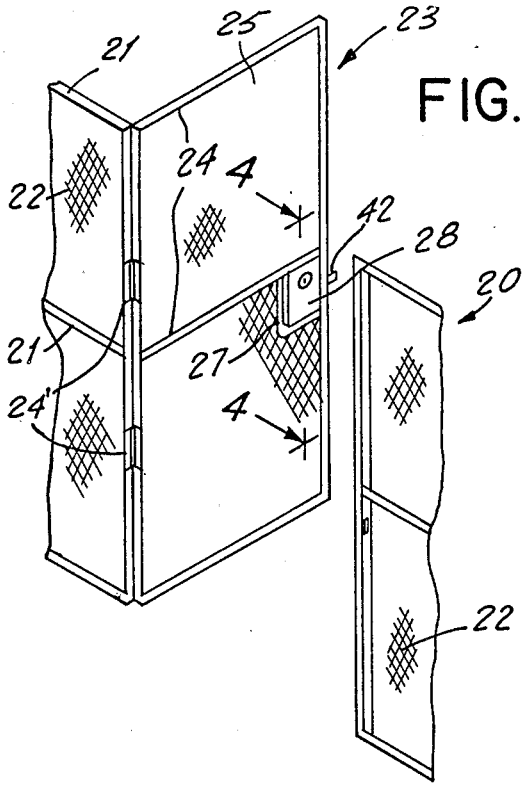
FIG. 1 is a fragmentary perspective view of a woven-wire partition having a swinging gate shown in open condition.
Figure 2:
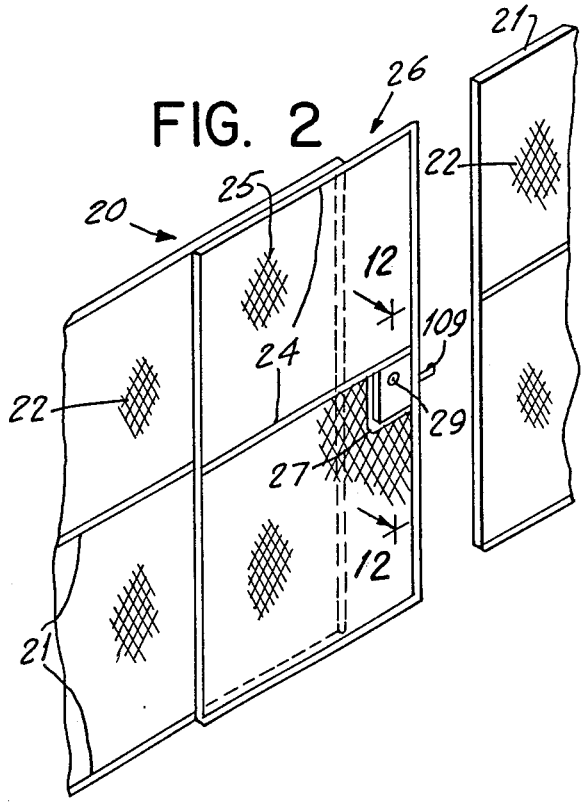
FIG. 2 is a fragmentary perspective view of a woven-wire partition having a sliding gate shown in partially open condition.

FIGS. 1 and 2 illustrate portions of woven-wire partitions 20 including panels made of joined-together metal frame elements 21, the openings of which are closed by woven-wire mesh 22. In FIG. 1, the partition is furnished with a swinging woven-wire gate 23 supported on hinges 24'. Like the individual panels of the partition, gate 23 is formed by metal frame elements 24, the openings of which are closed by woven-wire mesh 25.

In FIG. 2, the partition is furnished with a sliding gate 26, supported by horizontal guides or tracks,(not shown), gate 26 also being formed of metal frame elements 24, the openings of which are closed by woven wire mesh 25. Both of the gates 23 and 26 are fabricated with an L-shaped frame element 27, which together with portions of frame elements 24 define a rectangular opening in each gate adapted to accommodate a gate lock. In FIG. 1, a gate lock 28 is mounted in swinging gate 23, and in FIG. 2, a gate lock 29 is mounted in sliding gate 26.

Figure 3:
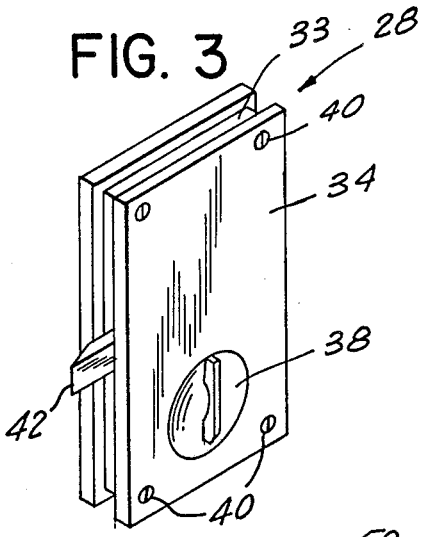
FIG. 3 is a perspective view of a woven-wire gate lock used with a swinging gate, the view being taken from the faceplate side of the housing.
Figure 4:
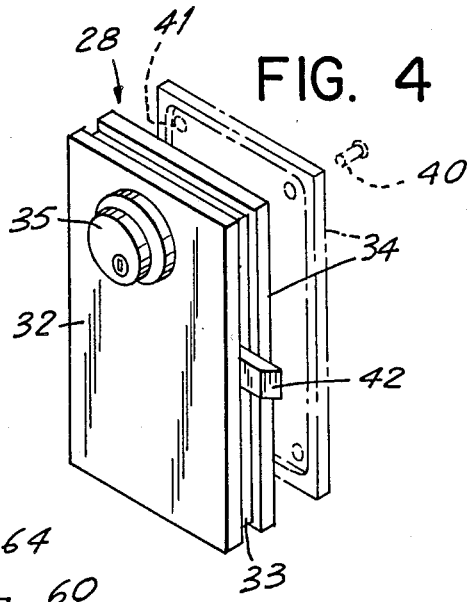
FIG. 4 is a perspective view of the lock of FIG. 3 taken from the cover side of the lock housing.

Gate lock 28, shown in FIGS. 3 and 4, includes a housing having a faceplate 32, an edge wall 33 projecting from the faceplate and substantially surrounding the interior of the housing, and a removable cover 34 for closing the housing. A conventional mortise lock cylinder 35 is threaded into an internally threaded hole 36 (see FIG. 5) in faceplate 32, the lock cylinder being maintained in the desired orientation by a set plate 37. A fingerpiece 38, comprising a disk having an outwardly projecting ridge, is rotatably carried by cover 34, the interior of the fingerpiece presenting two inwardly projecting detents 39 (see FIG. 8). Cover 34 is secured to the remainder of the housing by four screws 40 which pass through four holes 41 (FIG. 8) near the corners of cover 32 and are threaded into thickened regions at the corners of edge wall 33. Exposed on the exterior of housing is the tongue portion 42 of a reciprocable latch 43 (FIG. 5), the tongue passing slidably through a slot 44 in edge wall 33 at about the horizontal center line of the housing. A similar slot 44' (FIG. 5) is located in edge wall 33 directly opposite slot 44, tongue 42 passing slidably through slot 44' when the orientation of latch 43 is reversed with respect to the position shown in FIG. 5.

In order to mount lock 28 on gate 23, cover 34 is removed, and edge wall 33 is inserted into the opening defined by frame elements 24 and 27. As may be seen in FIGS. 5 and 7, the opening is large enough to accommodate wall 33, but does not allow faceplate 32 to pass through it. Hence, the margin of faceplate 32 abuts against frame elements 24 and 27. As a result, the frame elements are sandwiched between the margins of faceplate 32 and 34 so as to secure the lock to the gate. Alternatively, only the frame element 27 may be sandwiched between the margins of the faceplate and cover, and the edges of the faceplate and cover could abut against frame elements 24, the tongue 42 passing through opening 46 in vertical frame element 24 serving to help retain lock 28 in the gate. The margin of cover 34 is formed with an inwardly directed lip 35 (FIGS. 7 and 8) which surrounds the free edge of wall 33. The description given above for mounting lock 28 in swinging gate 23 applies equally to mounting lock 29 in sliding gate 26.

Figure 9:
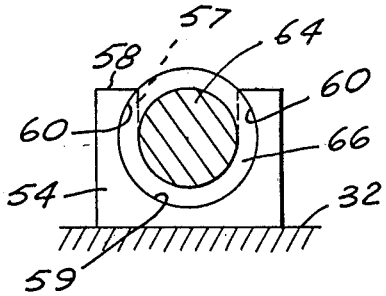
FIG. 9 is a fragmentary cross-sectional view taken along line 9—9 of FIG. 5.

In the region of the housing between its horizontal center line and lock cylinder 35, the inner surface of faceplate 32 is formed with two shallow bosses 48, and from the center of each projects a post 49 and 50, the two posts being symmetrically arranged with resect to the vertical center line of the housing. The inner surface of face plate 32 is also formed with a third boss 51 from which projects a shorter post 52 on the side of the horizontal center line of the housing opposite posts 49 and 50. Along the horizontal center line of the housing, faceplate 32 is formed with a thickened region 53 from which a bracket 54 (see also FIGS. 9 and 12) projects, the bracket being located at the intersection of the horizontal and vertical center lines of the housing.

Bracket 54 is formed with a generally U-shaped cutout 57 terminating at the endface 58 of the bracket. Formed in each of the two faces of bracket 54 facing toward slots 44 and 44' is a circular counterbore 59. The counterbore does not trace a complete circle, since it is truncated by the endface 58 of the bracket. However, counterbore 59 does extend through an angle considerably larger than a semicircle, so that it creates two overhanging ledges 60 directly beneath endface 58 of the bracket.

It will be seen that each of the ledges 60 is spaced from and faces faceplate 32. While use of a part circular counterbore or depression in the bracket surface is a convenient way of forming the ledges, other suitable methods could be employed to provide a ledge spaced from and facing faceplate 32.

Latch 43 (FIGS. 5–7 and 12) comprises tongue 42, a U-shaped head 63-, and a rigid connecting rod 64 interconnecting the tongue and head. A compression spring 65 surrounds connecting rod 64, one end of the spring seating against the inner face of tongue 42, and the other end of the spring seating against an enlargement member 66 in the form of a washer surrounding connecting rod 64 and slidable along the length of the rod. Washer 66 is snugly accommodated within counterbore 59 (see FIGS. 7 and 9), the overhanging ledges 60 preventing movement of washer 66, and hence connecting rod 64, in a direction away from faceplate 32. Spring 65, pressing on washer 66, maintains the washer within counterbore 59. At the same time, spring 65, located between bracket 54 and latch tongue 42, constantly urges the latch in a leftward direction in FIG. 5, i.e., constantly urges latch tongue 42 toward its extended latched condition.

Figure 5:
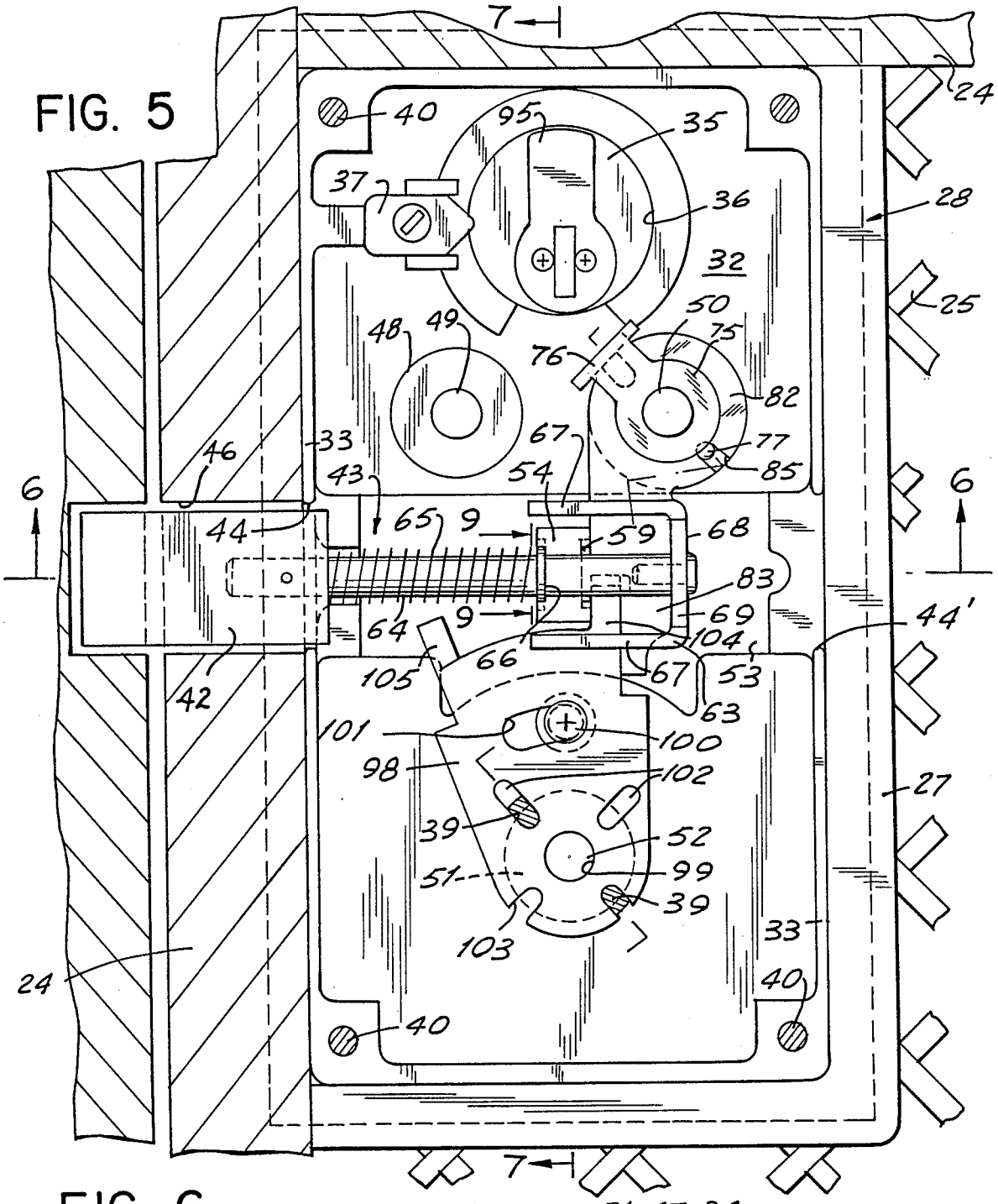
FIG. 5 is an elevational view of the lock mounted in a swinging gate, the cover of the lock being removed.
Figure 6:
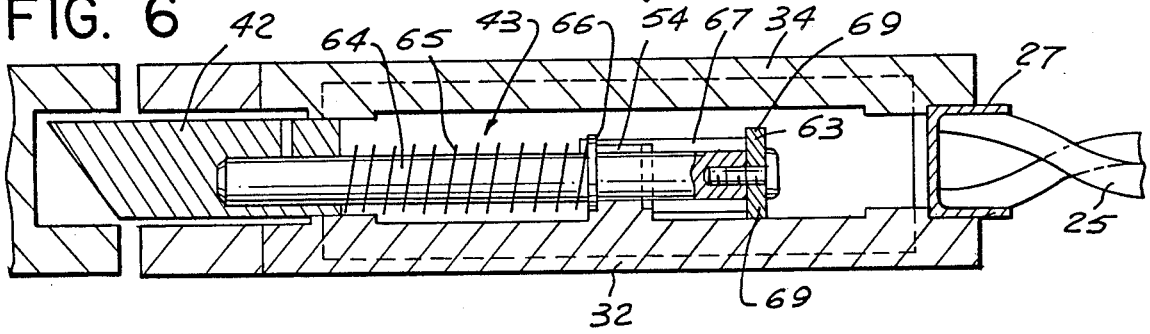
FIG. 6 is a horizontal cross-sectional view taken along line 6—6 of FIG. 5.
Figure 12:
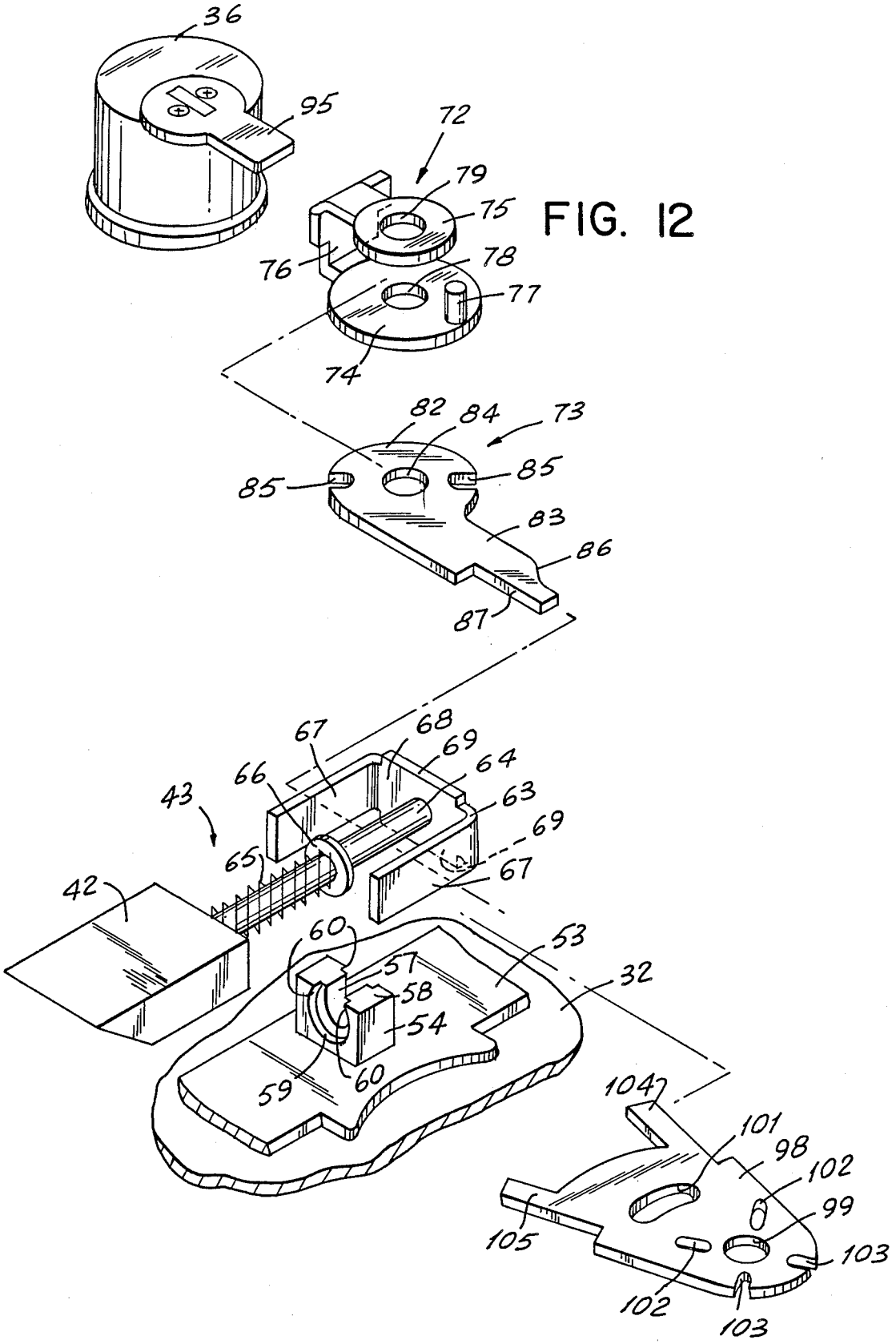
FIG. 12 is an exploded perspective view of internal parts of the lock shown in FIG. 5.

Latch head 63 comprises two arms 67, extending in the longitudinal direction of the latch, joined by a bridge 68 (FIGS. 5 and 12). The latch head is secured to the end of connecting rod 64, opposite tongue 42, at the center of bridge 68. Projecting in opposite directions from bridge 68, in directions perpendicular to the plane containing arms 67, are two lugs 69.

A linkage arrangement is provided for transmitting movement of the mortise lock cylinder 35 to latch 43 for the purpose of retracting the latch so as to permit gate 23 to be opened. The arrangement includes a part 72 and a link 73 (FIG. 12). Part 72 comprises coaxially arranged lower and upper annular disks 74 and 75, respectively, joined by a connecting piece 76. A pin 77 projects from the face of disk 74 which faces disk 75, the pin being diametrically opposite connecting piece 76. Disk 74 has a central hole 78, and disk 75 has a central hole 79.

Link 73 includes a disk-like portion 82 from which extends a camming arm 83. Disk-like portion 82 is formed with a central hole 84 and two diametrically opposite edge notches 85. At its free end, camming arm 83 is reduced in width to define a curved camming surface 86, and a cutout region 87.

Part 72 and link 73 are arranged for pivotal movement about post 50 projecting from faceplate 32 (FIGS. 5 and 7). Specifically, disk 74 rests upon boss 48 with post 50 extending through hole 78. Disk-like portion 82 of link 73 is located upon disk 74, post 50 passing through hole 84, and one of the notches 85 engaging pin 77. Camming arm 83 is located between the thickened portion 53 of faceplate 32 and the arms 67 of latch head 63. Camming surface 86 of camming arm 83 engages the lug 69 of the latch head closest to faceplate 32, and the opposite edge of the camming arm engages bracket 54 when latch 43 is in its extended condition, as shown in FIG. 5.

As illustrated in FIG. 8, the inner surface of cover 34 is formed with two bosses 90 from which project two short posts 91 and 92, these short posts being coaxial with posts 49 and 50, respectively, when cover 34 is mounted on the remainder of the lock housing. As indicated in FIG. 7, short post 92 is located in hole 79 of disk 75, so as to stabilize part 72 during its pivotal movement.

Figure 10:
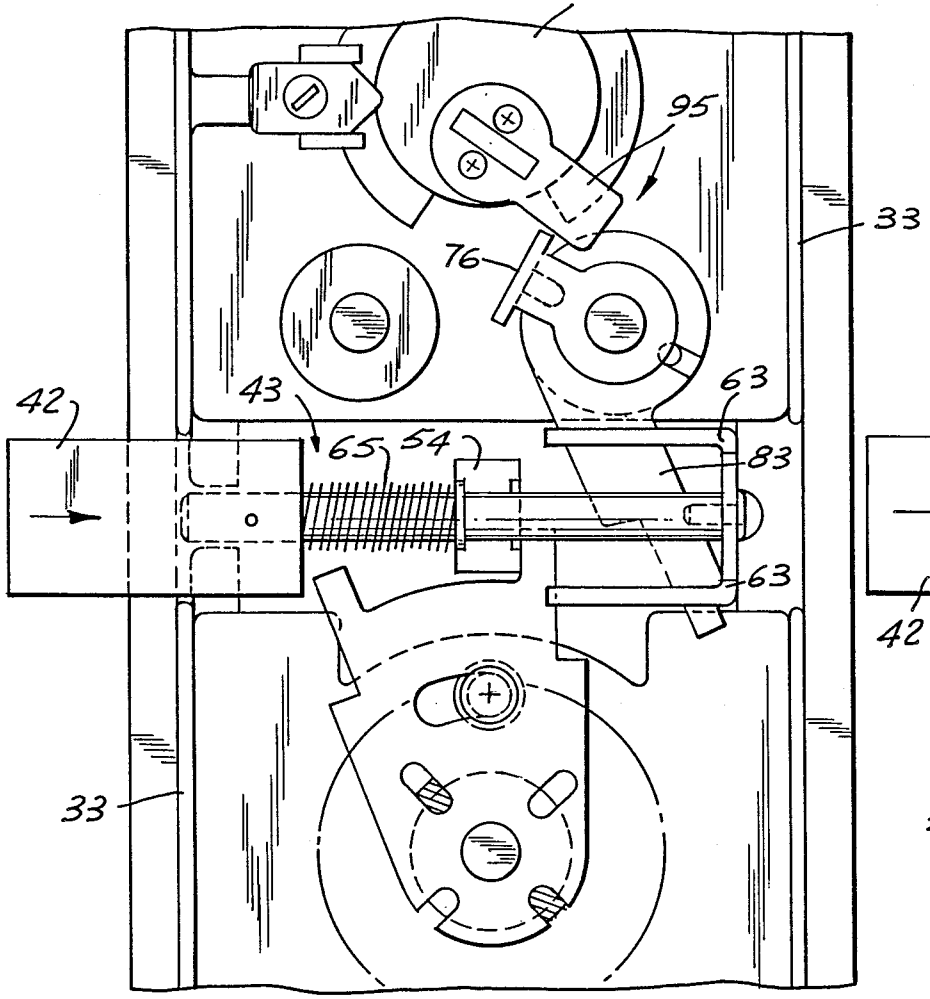
FIG. 10 is a fragmentary view, similar to FIG. 5, showing the latch retracted by actuation of the key-operable lock cylinder carried by the faceplate of the lock housing.

When a key 94 (FIG. 7) is inserted into the lock cylinder 35 and rotated, a tang 95 rotates from its position shown in FIG. 5, wherein latch 43 is in its extended condition, to the position shown in FIG. 10, wherein latch 43 has been retracted to permit opening of the gate. Connecting piece 76 of part 72 is located in the path of movement of tang 95. Hence, as the tang rotates, it engages connecting piece 76 and pivots that piece about the axis of posts 50 and 92. Because of the cooperation of pin 77 with notch 85, link 73 is also rotated in a counterclockwise direction in FIG. 10. Because of the engagement between camming surface 86 of camming arm 83 and lug 69 of latch head 63, latch 43 is moved toward the right in FIG. 10, against the force of spring 65, to its retracted position. When key 94, and hence tang 95, are rotated back to their initial positions (FIG. 5), spring 65 moves latch 43 longitudinally to its extended condition, this movement being limited by engagement of camming arm 83 with bracket 54.

Lock 28 is mounted in gate 23 in such a way that mortise lock 35 faces the area outside the area enclosed by the partition. Facing the interior of the enclosed area is fingerpiece 38, rotatably carried by cover 34, by means of which latch 43 can also be retracted so as to permit opening of the gate. Pivotally mounted on post 52, projecting from faceplate 32, is an actuator 98 having a hole 99 through which post 52 projects. A screw 100 is threaded into faceplate 32 through an arcuate slot 101 in actuator 98. The diameter of the screw head is larger than the width of slot 101, and hence prevents the actuator from accidentally falling out of the lock housing. Actuator 98 is also formed with two elongated slots 102 and edge notches 103 extending along diameters of hole 99. The two detents 39 projecting inwardly from fingerpiece 38 extend into one of the slots 102 and one of the notches 103 of actuator 98. In this way, pivotal movement of fingerpiece 38 is transmitted to actuator 98. The actuator also includes two radially projecting ears 104 and 105. As shown in FIG. 5, ear 104 is accommodated within cutout 87 of camming arm 83, so that ear 104 fits between the camming arm and bracket 54.

Figure 11:
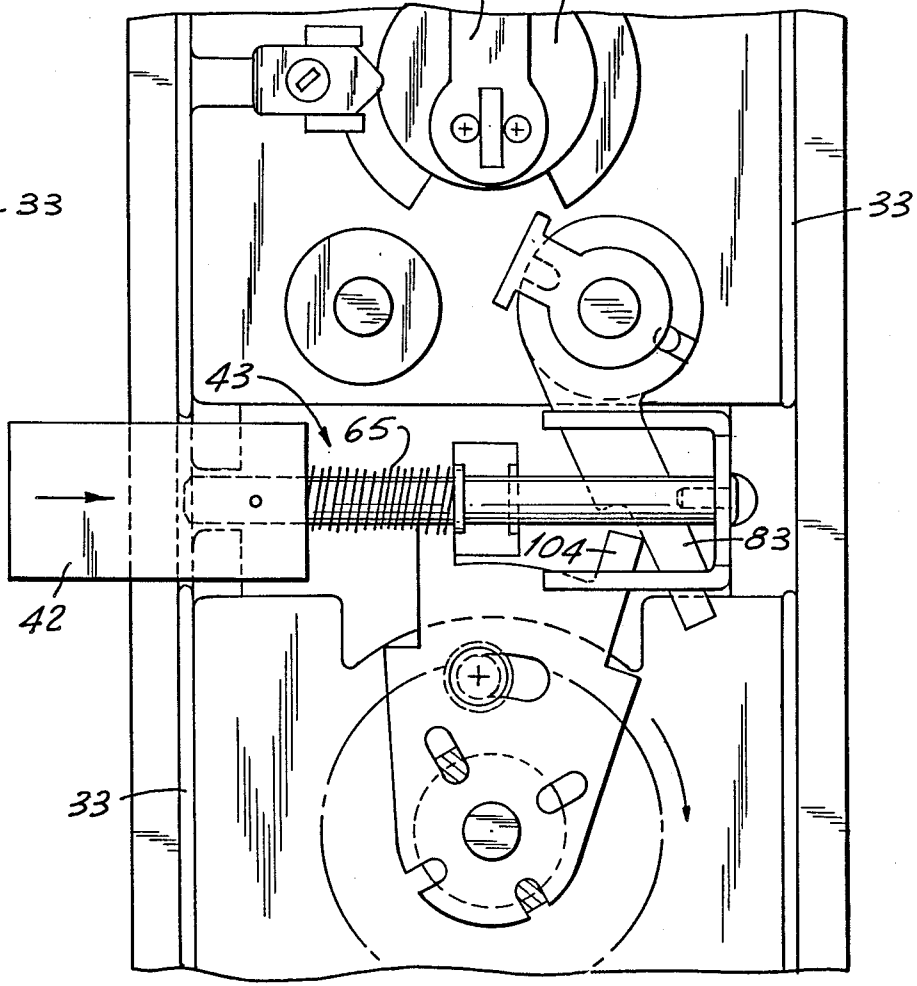
FIG. 11 is a view similar to FIG. 10 showing the latch retracted by actuation of the pivotable fingerpiece carried by the lock housing cover.

When fingerpiece 38 is rotated, so as to rotate actuator 98 from the position shown in FIG. 5 to the position shown in FIG. 11, ear 104 transmits this motion to link 73 via the engagement between ear 104 and camming arm 83. Due to the engagement between camming surface 86 and lug 69 of latch head 63, latch 43 is moved toward the right in FIG. 11 to its retracted position. Upon releasing fingerpiece 38, spring 65 returns latch 43 to its extended position.

Because camming arm 83 of link 73 is located between the thickened region 53 of faceplate 32 and arms 67 of latch head 63, latch 43 prevents link 73 from accidentally falling out of the lock housing when the housing is open. Furthermore, since disk 74 of part 72 is located between the disk-like portion 82 of link 73 and faceplate 32, part 72 is prevented, by link 73, from accidentally falling out of the housing when the latter is open. As explained above, spring 65 maintains washer 66 within counterbore 59 so that overhanging ledges 60 prevent the washer from moving in a direction away from faceplate 32, and the washer prevents connecting rod 64 and the remainder of latch 43 from moving away from faceplate 32, i.e., falling out of the housing. As a result, even if the open housing is dropped, latch 43 cannot fall out of the housing, and the latch prevents part 72 and link 73 from falling out of the housing. Actuator 98 is prevented from falling out of the housing by the head of screw 100.

If lock 28 is to be used with a gate which swings along its edge opposite the edge along which gate 23 swings, part 72 and link 73 are mounted on post 49 instead of on post 50, in mirror image relation to their orientation in FIG. 5, and latch 43 is reversed so that tongue 42 projects through slot 44' in edge wall 33, and washer 66 fits into the counterbore 59 in the face of bracket 54 which faces slot 44'.

Figure 13:
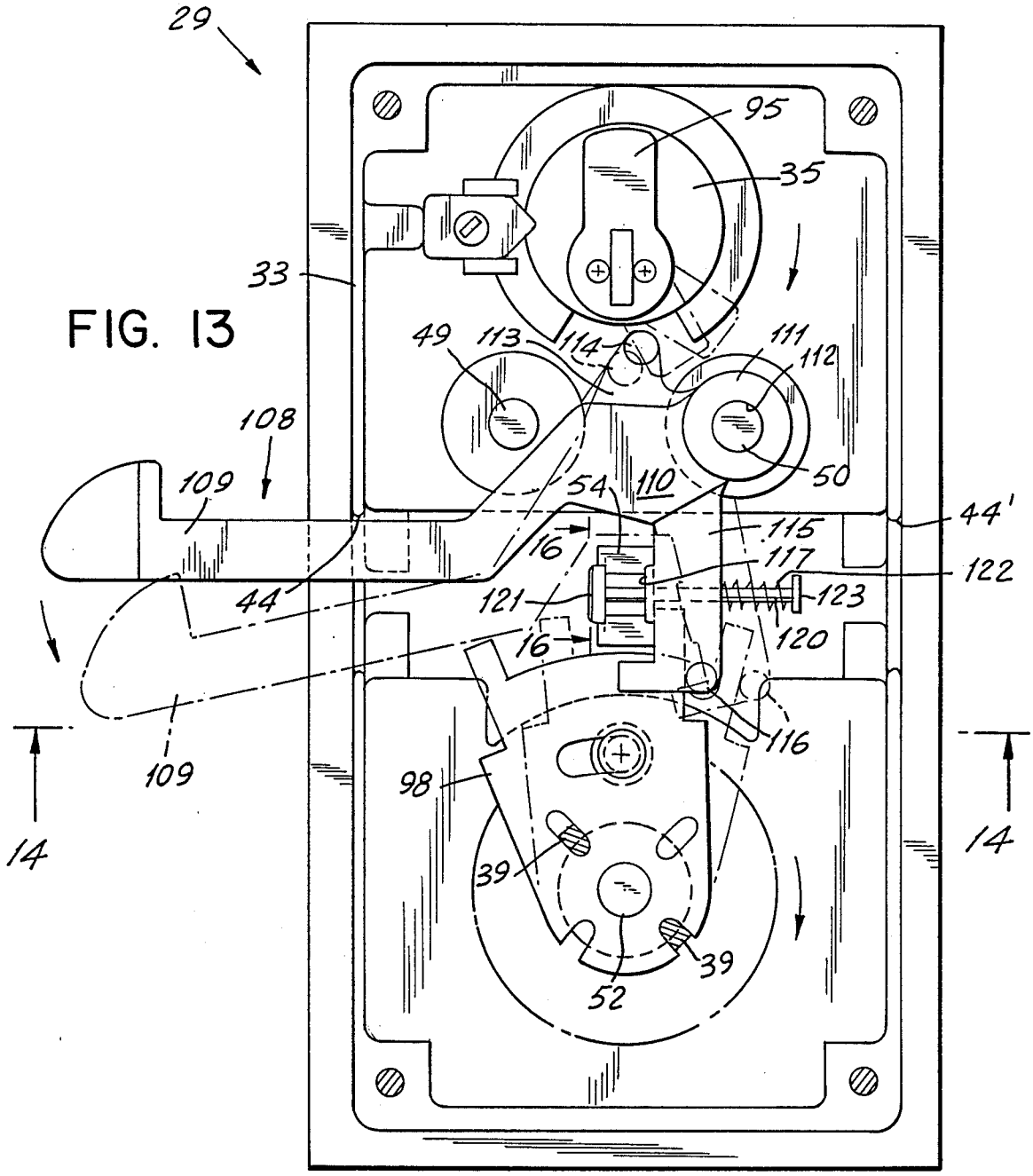
FIG. 13 is an elevational view of a lock, with the housing cover removed, having a latch of the type employed with a sliding gate.
Figure 14:
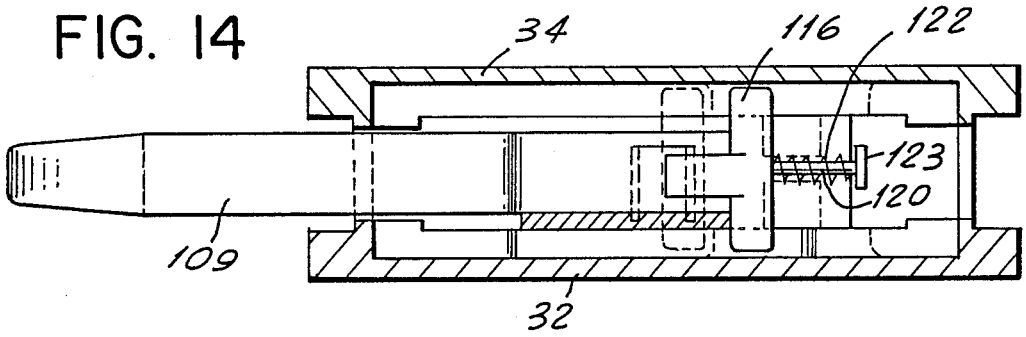
FIG. 14 is a horizontal cross-sectional view taken along line 14—14 of FIG. 13.

Gate lock 29, used in sliding gate 26, is identical to gate lock 28, with the following exceptions: part 72 and link 73 are not employed, and reciprocable latch 43 is replaced by pivotable latch 108 (FIGS. 13–15). Latch 108 includes a latch tongue 109 extending through slot 44 in edge wall 33. Tongue 109 is much narrower than slot 44, so that the tongue is free to oscillate within the slot. At its end within the lock housing, tongue 109 merges into a body portion 110 which itself merges into a hub 111 having a through hole 112. Hub 111 fits on post 50, projecting from faceplate 32, the post being accommodated within hole 112 so as to pivotally support latch 108.

A tab 113 extends from body portion 110, and carries a lateral pin 114. An L-shaped extension 115 also extends from body portion 110, the extension carrying a transverse pin 116 at the intersection between the leg and foot of the L. Between the ends of the leg of the L-shaped extension 115 it is formed on one face with a generally rectangular projecting lug 117 (see also FIG. 16), and a hole is provided in the leg of extension 115 at a point where it passes through the center of lug 117.

Slidably arranged within the hole in extension 115 is a thin rod 120 having an enlarged circular head 121 at one end, the head being snugly accommodated within counterbore 59 in bracket 54. At the same time, lug 117 fits into counterbore 59 in the opposite face of bracket 54. The ledges 60 defined by both counterbores, cooperating with head 121 and lug 117, respectively, serve the same purpose as the cooperation between washer 66 and counterbore 59, namely, preventing movement of latch 108 in a direction away from faceplate 32 so as to prevent latch 108 from accidentally falling out of the lock housing when the latter is open. A compression spring 123 surrounds rod 120, one end of the spring seating against the face of extension 115 opposite the face carrying lug 117, and the other end of the spring seating against an enlargement 123 on the end of rod 120 opposite the end carrying head 121.

Latch 108 may be swung from its latched condition, shown in solid lines in FIG. 13, to its unlatched condition, shown in broken lines in FIG. 13, either by manipulating mortise lock cylinder 35, by means of key 94, or manipulating fingerpiece 38. When the mortise lock cylinder is rotated, tang 95 rotates and engages pin 114, as shown in broken lines in FIG. 13. Continued rotation of tang 95 causes latch 108 to pivot about post 50 in a counterclockwise direction, against the force of spring 122, so as to move tongue 109 from its latched to its unlatched condition. Upon return of tang 95 to its original position, spring 122 pivots latch 108 in a clockwise direction about post 50 back to its latched condition.

When fingerpiece 38 is rotated, actuator 98 moves from its solid line to its broken line position in FIG. 13. Due to the engagement between the actuator and pin 116, the latch is pivoted against the force of spring 122 in a counterclockwise direction to its unlatched condition. Upon release of fingerpiece 38, spring 122 returns the latch to its latched condition.

It will be appreciated that spring 122 serves both to constantly urge latch 108 toward its latched condition, and also to maintain head 121 of rod 120 within counterbore 59, this engagement preventing latch 108 from falling out of the lock housing. In sliding gate lock 29, cutout 57 in bracket 54 serves as a passageway through which rod 120 passes from its head 121 to and beyond extension 115 of the latch. In swinging gate lock 28, connecting rod 64 is of larger diameter than rod 120, and hence more completely fills cutout 57, so that bracket 54 serves to help guide the reciprocating movement of latch 43.

Depending upon the direction of sliding movement of the sliding gate, with which lock 29 is used, the orientation of latch 108 could be reversed. In such a case, hub 111 is pivotally supported on post 49 rather than post 50, and tongue 109 projects through slot 44' in edge wall 33 rather than through slot 44.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

I claim:

1. A woven-wire gate lock comprising:

a housing having a faceplate, a wall projecting from the faceplate and substantially surrounding the interior of the housing, and a removable cover for closing the housing, a stationary bracket within the housing projecting from the faceplate, the bracket presenting two opposite surfaces each having a ledge spaced from and facing the faceplate, and the bracket having an endface remote from the faceplate, a cutout in the bracket terminating at the endface so that the cutout is open at the endface, a latch projecting from the housing and movable with respect to the housing between latched and unlatched positions, the latch being reversible so that it can project from the housing in either of two opposite directions, a rod carried by the latch, the rod being accommodated within the cutout in the bracket, the rod being insertable into and removable from the cutout through the opening of the cutout at the bracket endface, manually-manipulable means carried by the housing for initiating movement of the latch from its latched position to this unlatched position, a spring constantly urging the latch toward its latched position, and a member engageable with the bracket in a location between the faceplate and either of the two ledges, the ledge with which the member cooperates preventing movement of the latch in a direction away from the faceplate, and the spring maintaining the engagement between the member and the bracket, whereby the latch is prevented from accidentally falling out of the housing when the housing cover is is removed and the housing is open.

2. A woven-wire gate lock as defined in claim 1 wherein said member is carried by the latch.

3. A woven-wire gate lock as defined in claim 2 wherein the spring is carried by the latch and the spring constantly urges said member toward the bracket.

4. A woven-wire gate lock as defined in claim 1 wherein said member is a washer adapted to fit against a face of the bracket beneath the ledge, the washer being movable with respect to the latch.

5. A woven-wire gate lock as defined in claim 1 wherein the housing wall has an opening, the latch having a tongue slidably arranged within the opening and a connecting rod extending longitudinally from the tongue, the bracket cooperating with the connecting rod for guiding the longitudinal movement of the latter, and said member being an enlargement on the connecting rod adapted to fit beneath the ledge of the bracket.

6. A woven-wire gate lock as defined in claim 5 wherein said member is a washer surrounding and slidable along the connecting rod, and the spring surrounds the connecting rod and maintains the washer in engagement with the bracket at a location beneath the ledge.

7. A woven-wire gate lock as defined in claim 1 including at least one link within the housing for transmitting movement of the manually-manipulable means to the latch, the link being located between the latch and the housing faceplate.

8. A woven-wire gate lock as defined in claim 7 wherein the housing wall has an opening, the latch having a tongue at one end slidably arranged within the opening and a head at its other end within the housing, the link being located between the latch head and the housing faceplate and engaging the latch head to transmit movement of the manually-manipulable means to the latch.

9. A woven-wire gate lock as defined in claim 8 wherein latch head is generally U-shaped to define two arms joined by a bridge, the arms of the latch head extending in the direction of movement of the latch, the link being located between the arms of the latch head and the housing faceplate, and the bridge of the latch head extending between the arms being enlarged for engagement by the link.

10. A woven-wire gate lock as defined in claim 1 wherein the two opposite surfaces of the bracket are perpendicular to the faceplate, and each surface is formed with a depression, each depression undercutting the bracket endface to form a ledge.

11. A woven-wire gate lock as defined in claim 1 wherein the housing wall has an opening, and including means within the housing for pivotally supporting the latch, the latch having a tongue extending through the opening, a rod carried by and slidable with respect to the latch, said member being an enlargement on the rod adapted to fit beneath the ledge of the bracket.

12. A woven-wire gate lock as defined in claim 11 wherein the spring surrounds the rod and maintains the enlargement in engagement with the bracket at a location beneath the ledge.

13. A woven-wire gate lock as defined in claim 11 wherein the latch has an extension fixed with respect to the tongue, the rod being slidably carried by the extension, and including a lug projecting from the extension and being located beneath the ledge in the bracket surface opposite the ledge beneath which the enlargement is located.

* * * * *